US008529365B1

(12) United States Patent
Davis

(10) Patent No.: US 8,529,365 B1
(45) Date of Patent: Sep. 10, 2013

(54) INDOOR GOLF SWING PRACTICE IMPLEMENT

(76) Inventor: Steven R. Davis, Flagler Beach, FL (US)

( * ) Notice: Subject to any disclaimer, the term of this patent is extended or adjusted under 35 U.S.C. 154(b) by 283 days.

(21) Appl. No.: 13/118,619

(22) Filed: May 31, 2011

(51) Int. Cl.
*A63B 69/36* (2006.01)

(52) U.S. Cl.
USPC ..... 473/256

(58) Field of Classification Search
USPC ..... 473/256, 226, 219
See application file for complete search history.

(56) References Cited

U.S. PATENT DOCUMENTS

| | | | | | |
|---|---|---|---|---|---|
| 1,524,196 | A | * | 1/1925 | Matthews | 473/256 |
| 1,953,916 | A | | 4/1934 | Adams | |
| 2,462,955 | A | * | 3/1949 | Glancey | 473/227 |
| 2,595,717 | A | | 5/1952 | Smith | |
| 3,231,281 | A | | 1/1966 | Wallo | |
| 3,351,346 | A | | 11/1967 | Strahan | |
| 3,414,260 | A | | 12/1968 | Gust | |
| 3,743,297 | A | | 7/1973 | Dennis | |
| 3,999,765 | A | * | 12/1976 | Bishop | 473/238 |
| 4,118,033 | A | | 10/1978 | Miyamoto | |
| 4,511,147 | A | | 4/1985 | Olsen | |
| 4,602,788 | A | | 7/1986 | Wendt | |
| 4,809,975 | A | * | 3/1989 | Lee | 482/110 |
| 4,878,673 | A | * | 11/1989 | Pollard | 473/409 |
| 5,026,063 | A | | 6/1991 | Rhodes | |
| 5,083,790 | A | * | 1/1992 | Wheatley | 473/256 |
| 5,121,925 | A | | 6/1992 | Blundo | |
| 5,215,307 | A | | 6/1993 | Huffman | |
| 5,582,407 | A | | 12/1996 | Sorenson | |
| 5,989,131 | A | * | 11/1999 | Burkholder | 473/219 |
| 6,186,904 | B1 | | 2/2001 | Bass | |
| 6,217,495 | B1 | | 4/2001 | Yalch | |
| 6,358,157 | B1 | | 3/2002 | Sorenson | |
| 6,379,261 | B1 | | 4/2002 | Hart | |
| 6,475,098 | B1 | | 11/2002 | Nemeckay | |
| 6,780,118 | B1 | | 8/2004 | McCartney | |
| 6,955,610 | B1 | | 10/2005 | Czaja et al. | |
| 6,966,844 | B2 | * | 11/2005 | Welles | 473/224 |
| 7,553,239 | B2 | * | 6/2009 | Pullaro | 473/256 |
| 2002/0132678 | A1 | | 9/2002 | Matzie | |
| 2003/0224867 | A1 | | 12/2003 | Ota | |
| 2004/0009826 | A1 | | 1/2004 | Aisenberg | |
| 2005/0148402 | A1 | * | 7/2005 | Welles | 473/219 |
| 2005/0261075 | A1 | * | 11/2005 | Pullaro | 473/256 |
| 2012/0077611 | A1 | * | 3/2012 | Lorince | 473/256 |

* cited by examiner

*Primary Examiner* — Raleigh W Chiu

(57) ABSTRACT

An indoor golf swing practice implement is provided with a total length from 16 to 20 inches and including a shaft with a standard golf grip on one end and with a weight at the other end. The total weight and balance of the practice implement is such that the implement moment is substantially the same as that of a regular golf club to provide the same feel, heft and swinging weight for practice of golf strokes in confined spaces.

8 Claims, 6 Drawing Sheets

INDOOR GOLF SWING PRACTICE IMPLEMENT

BACKGROUND OF THE INVENTION

The invention relates to technique practice implements for golf and is distinguished from exercise devices utilizing weight resistance for weight training, strength training or muscle conditioning.

The balance, felt heft and swinging weight of golf clubs have been measured and compared since around the year 1934 by measuring the moment (torque, or moment of force) of the golf club produced by the weight of the golf club acting at its center of gravity about an axis (or fulcrum) that is a predetermined distance from the butt end (proximal end) of the golf club. This moment has been known since about 1934 as the swinging weight, swingweight moment or simply the swingweight of the club. The most widely used predetermined distance from the butt of the club is 14 inches, but any other distance could be used; and 12 inches was proposed around the year 1948 but has not gained widespread favor in the golf club industry. The swingweight moment is directly expressed in terms like inch-grams. The golf club industry widely uses the "Lorythmic" swingweight scale to translate these inch-gram measurements into a letter and number scale like D2 which is equal to a 14 inch fulcrum swingweight moment of 6150 inch-grams. Each numerical step equals a 50 gram change in the swingweight moment. Swingweight moment is distinguished from moment of inertia which is very sensitive to the length of the golf club and is expressed in terms like gram-inches squared (gram-inches squared).

There are few, if any, neutrally weighted full length golf training aides, that is to say few that are not overly heavy and not substantially eccentrically off balanced relative to a conventional club. If a user desires a full size implement for practicing the golf swing that is weighted like and, when swung in the manner of a golf club, feels like a conventional golf club, the user is likely to choose a conventional golf club, with which the user can either practice his swing or hit balls on a driving range. Most golf swing training devices are consistently relatively heavy compared to a conventional golf club because their objective is muscle strengthening or muscle training. There is no shortened golf swing practice implement available that is weighted and balanced to feel like a conventional golf club and yet is substantially smaller than conventional golf clubs.

The prior art devices are typically either 1) heavier than a regular golf club for weight training, muscle training or muscle building, or 2) axially offset to exaggerate the release of the wrists in the swing. The devices disclosed by Matthews (U.S. Pat. No. 1,524,196) are both shortened and stated to be intended to feel like a regular golf club. However, the Matthews device is based on the calculation of the moment of the implement around the fixed point of the left shoulder of a golfer. This use of moment calculation of golf implements is inadequate to determine the "heft" or "swinging weight" of the implement which is believed to be a better determinant of the perceived feel of a club.

In 1934, Robert Adams patented the first "Apparatus for Measuring the Moments of Golf Clubs and the Like" (Adams, U.S. Pat. No. 1,953,916). Adams disclosed that the "heft" or "swinging weight" of a golf club could be measured and compared by determining the moment of the golf club "about a point a fixed distance from one end of the implement"; and then "found in actual practice that satisfactory results are realized if the fixed point is fourteen inches from the grip end."

The Adams swingweight moment calculation is sensitive to changes in the center of gravity in the club itself. The Matthews' moment calculation is relatively insensitive to changes in the center of gravity in the club itself. The relatively long moment arms in the Matthews device reduce the importance of the balance, mass distribuition and feel of the practice implement itself. As a result, the Matthews moment calculation is not effective for determining how the exercise implement will "feel" when swung by a golfer. The resulting device "feels" like a regular golf club only if the wrists are not cocked in the backswing or uncocked in the downswing. The required stiff armed swing is not a golf swing. When swung like a regular golf club, with a regular golf swing, including the cocking of the wrists in the backswing, the uncocking of the wrists in the downswing, and the refolding of the wrists in the followthrough, the Matthews device would feel extremely light; its "heft" or "swinging weight" are not at all similar to a regular golf club. It offers too little of the swingweight moment of a regular length golf club around the center of motion of the hands and wrists. The center of gravity of the Matthews device is very near the end weight, and therefore not balanced like a regular golf club.

Neither the techniques used by Matthews and Adams are useful for very short clubs. For example, the Adams 14 inch fulcrum point swingweight scale cannot be used to measure the "heft" or "swinging weight" of very short practice implements when the total length of the device is shorter than the 14 inch fulcrum point or when the center of gravity of the device is at, near or inside the 14 inch fulcrum point.

Examination of other prior art devices does not reveal a training device that is both substantially shorter than conventional golf clubs and yet retains the feel of a conventional club when used in typical golf swings. What is needed is a training device that can be swung in the exact manner of golf motions while the user is in limited space and that at the same time provides the user with the same feel of a conventional golf club.

SUMMARY OF THE INVENTION

The current invention is an indoor golf swing practice implement that is weighted and balanced to feel like a regular golf club but having a very short length which can be used indoors in very small spaces such as are found in nearly all homes, apartments or offices.

The inventive device is distinguished from prior art by the smaller size and neutral weighting of the inventive device. The weighting is neutral both in terms of user-perceived heft, balance, swinging weight and in regard to weight offset from the axis of the shaft of the device. In view of the foregoing, it is the object of this invention to produce an indoor golf swing practice implement of simple construction which feels like a conventional golf club but is approximately 18 inches in total length and therefore useable indoors in very small spaces.

The current invention balances the weight of the shaft and an end weight in such a way as to place the center of gravity of the device in the proportionally similar position to a conventional golf club of longer length resulting in the feel of an actual conventional golf club when swung by a skilled golfer.

The inventor has found that using a fulcrum point four inches from the butt of the very short practice implement produces satisfactory and useful comparative "heft" and "swinging weight" moment calculation for very short practice implements. In preferred embodiments, the current invention includes an elongated shaft with a concentrated weight secured to one end. Adjacent the other end, the shaft has a grip similar to a standard golf grip. The combined moments of the components of the implement, about a point four inches from the proximal or butt end of the implement, is in the range of 9,500 to 11,000 inch grams. At the same time, the center of gravity of the implement is located at a distance from the distal end of the club equal to 20 to 25 percent of the total length of the implement. These parameters have been found to satisfy the objective of the invention in a novel way.

The inventive implement provides a unique structure and method of personal golf practice and training unavailable in prior devices. Additional aspects and advantages of the inventive implement are made clear in the following discussion of exemplary embodiments and the accompanying figures.

DETAILED DESCRIPTION OF EMBODIMENTS OF THE INVENTION

List of Reference Numerals

Figure 1:
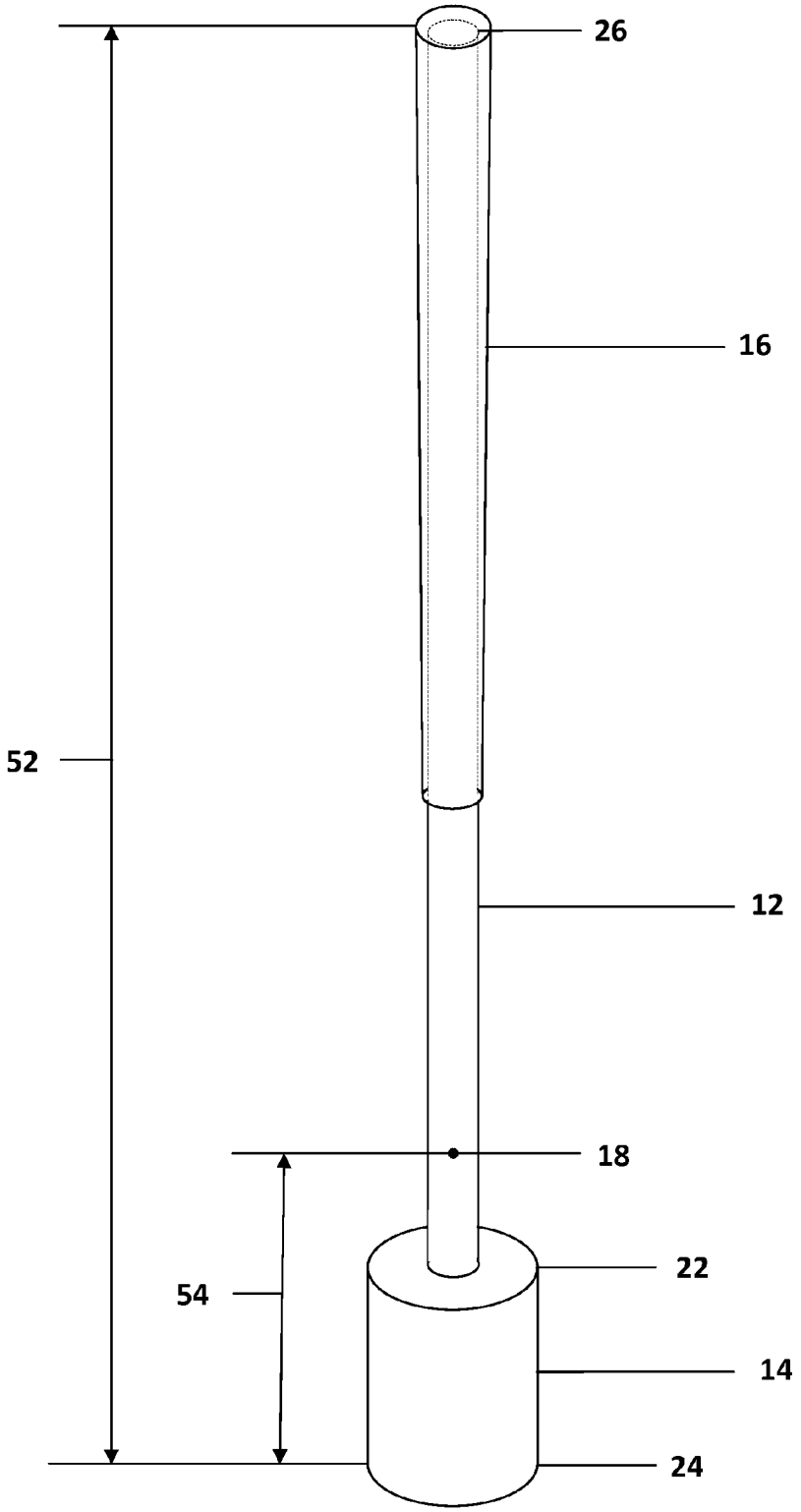
FIG. 1 is an isometric view of an inventive practice implement standing vertically on the cylindrical weight.

12 shaft
12*a* conventional club shaft
14 cylindrical end weight
16 grip
18 center of gravity
18*a* center of gravity of a conventional golf club
22 proximal end of the cylindrical end weight
24 distal end of the cylindrical end weight
26 proximal end of the shaft
28 distal end of the shaft
30 male threads
32 female threads
34 four inch swinging weight fulcrum point
34*a* four inch swinging weight fulcrum point on conventional club
38 simulated golf club head
38*a* conventional club head
39 heavy simulated golf club head
40 indicium on side of cylindrical weight
42 indicium on distal end of cylindrical weight
52 overall length of practice implement
52*a* overall length of conventional golf club
54 distance from distal end of practice implement to center of gravity
54*a* distance from distal end of conventional golf club to center of gravity The first embodiment of the practice implement is illustrated as FIG. 1 having a shaft 12, a cylindrical end weight 14 and a grip 16 for holding the practice implement by a user. The shaft 12 in a preferred embodiment is made of solid aluminum, but may be made of thick walled steel tube or solid steel. The cylindrical end weight 14 is made from solid steel, but may be made from any similarly heavy metal or other material. The grip 16 in the embodiment shown is a standard prior art golf grip, but may be a training grip.

Figure 2:
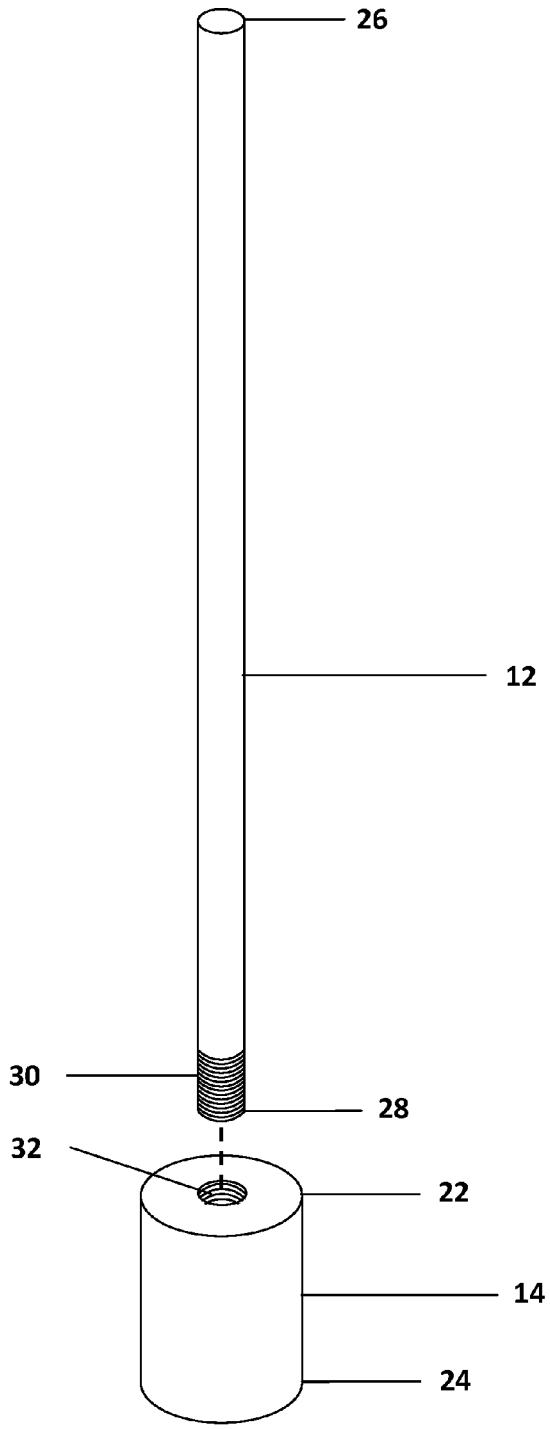
FIG. 2 is an isometric view of two parts of an inventive practice implement.

With reference to FIG. 2, the distal end of the shaft 28 preferably has male threads 30 which are threaded into the female threads 32 in the proximal end of the cylindrical end weight 22. The shaft 12 is tightened into a normally fixed position in the cylindrical end weight 14. The shaft 12 may be secured in the cylindrical end weight 14 by means of epoxy or other liquid applied gluing agent.

The distal end of the cylindrical end weight 14 preferably has a flat surface on which the practice implement can stand when stored on a flat surface.

Figure 6:
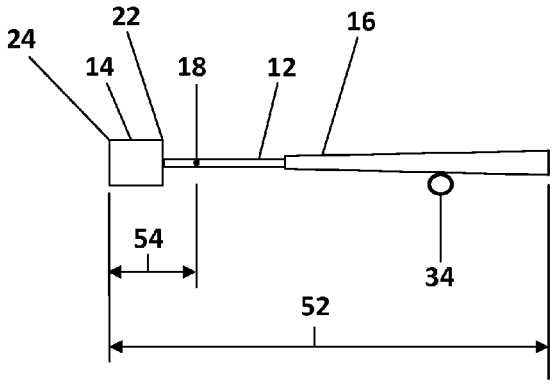
FIG. 6 is an elevation view of an inventive practice implement showing the location of a four inch swinging weight fulcrum point.
Figure 7:
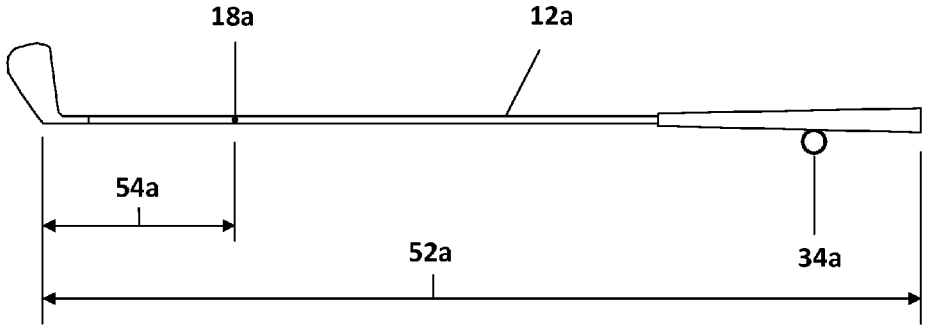
FIGURE 7 (PRIOR ART)
FIG. 7 is an elevation view of a conventional golf club (Prior Art) showing the location of the four inch swinging weight fulcrum point.

With reference to FIGS. 1 and 6, the center of gravity 18 of the practice implement is located in the shaft 12 at a predetermined center distance dimension 54 from the distal end of the implement. The center distance dimension 54 is in the range of 20 to 25 percent of the total length dimension 52 of the implement. In this manner, is the positioning of the center of gravity 18 is configured to be substantially similar to the center of gravity of a typical conventional golf club (See FIG. 7). FIG. 7 illustrates the location of the respective center of gravity 18*a* in the shaft of a conventional golf club: a respective center distance dimension 52*a* in the range of 20 to 25 percent of the total length 54*a* of the conventional golf club.

The inventive practice implement has a moment of between 9,500 and 11,000 inch grams resulting from the total mass of the practice implement at its center of gravity 18 acting around a four inch (from the proximal end of the implement) swing weighting fulcrum point 34 as shown in FIG. 6. Moments referenced herein are defined as and calculated about an imaginary transverse axis through the fulcrum point 34. No actual physical fulcrum is an element of the present inventive implement. Herein the term "moment" refers to the product of an object's mass and the object's effective lever arm distance perpendicular from the respective fulcrum.

The above 9,500 to 11,000 inch gram moment is substantially similar to the respective moment of a conventional golf club resulting from the total mass of the golf club at its center of gravity 18*a* acting around its respective four inch swing weighting fulcrum point 34*a* as shown in FIG. 7.

Experimentation has shown that an implement of only twelve inches in length is not long enough to create the feel of a regular golf club. Experimentation has shown that a length of approximately 18 inches is required to recreate the feel of a regular golf club. The total length dimension 52 of the embodiment of the practice implement shown in FIG. 1 is preferably 18 inches, but a length of from 16 to 20 inches will be satisfactory. The shaft 12 may be coated or painted to protect the metal surface or to create a desired aesthetic appearance. The cylindrical end weight 14 is suggested to have a mass in the range of 500 to 1000 grams to achieve the desired balance and moment and should be formed of steel or material of closely similar density to ensure small size.

When swung by a skilled golfer, the practice implement shown in FIG. 1 has a perceived heft and swinging weight that are substantially similar to that of a conventional golf club;

but is short enough to be used indoors in very small spaces, such as are found in most single family homes, apartments and offices.

The conventional method in the prior art of determining the heft and swinging weight of golf clubs involves the calculation of the moment from the total mass of the golf club at its center of gravity acting around the fulcrum point 14 inches from the club proximal end. This does not work for very short practice implements. Very short practice implements, such as desired in the invention, have a center of gravity that is too near this associated fulcrum point for useful calculations.

The inventor's experiments and investigation have determined that the four inch swing weighting fulcrum point 34 as shown in FIG. 6 will provide useful determinations of perceived heft and swinging weight for both very short practice implements and conventional golf clubs and will allow the comparisons of perceived heft and swinging weight. The four inch swinging weight fulcrum point 34 also eliminates the distorting impact of grip weight on swinging weight calculations. Experiments and investigations have determined that a moment of between 9,500 and 11,000 inch gram around the four inch swinging weight fulcrum point 34 will reproduce the felt heft and swinging weight of a conventional golf club. Using industry standard nomenclature, moments in the lower end of the above specified range will feel like lighter C6 to D0 swinging weight golf clubs. Moments in the high end of the range will feel like heavier D5 or D7 swinging weight golf clubs. Moments in the middle of the range will feel like standard D2 swinging weight golf clubs. Stronger men, or professional golfers may prefer a heavier weighting. Women and junior golfers may prefer a lighter weighting. In combination, the said moment of the practice implement and the balance of the practice implement created by the location of the center of gravity 18 of the practice implement produce when the practice implement is swung by a skilled golfer the feel of a conventional golf club.

A skilled golfer can grasp the inventive practice implement shown in FIG. 1 as he would a conventional golf club. The practice implement can then be swung in the same manner as a conventional golf club. The skilled golfer can use the device to practice swinging indoors in very small spaces. The skilled golfer can use the device to check positions of the hands, shaft and head in various positions in the full swing. The device is particularly useful for checking the cardinal positions in the backswing and the stages of wrist cocking. For instance, a skilled golfer can check the position of the shaft and head as the arms, hands and shaft reach horizontal. Of special concern for the skilled golfer is whether the head of the club when these positions are reached is in front of or behind the hands. Practice in front of a mirror can be used to augment the golfer's perceptions of swing positions. A wide variety of similar types of positions and relationships can be checked, adjusted and confirmed throughout the entire golf swing; and then repetitively practiced. The neutral weighting of the practice implement will allow golfers to practice full swings with full release of the wrists through impact.

The neutral weighting of the practice implement also allows the golfer to practice the smaller swings in the game that do not involve a full release. These smaller chipping swings are widely understood to involve a less aggressive cocking of the wrist in the backswing and then a holding of the wrist cock through the impact area. The neutral weighting of the inventive practice implement does not introduce overweighted momentum. Many prior art practice devices are very heavy or have a heavy weight offset from the axis of the shaft to induce unnatural momentum into the practice swinging. This unnatural momentum is undesirable in the present invention. Heavy weights do not produce the "soft hands" required for a good short game.

The indoor golf swing practice implement shown in FIG. 1 can be used all year long indoors in a variety of settings. The golfer in northern climates can use the device in the winter when access to golf courses is limited or impossible. The golfer can use the device all winter long to stay in golf condition with a well grooved swing instead of starting golf in the spring with a poorly grooved swing and in poor golfing condition. The working man or woman with little or no time during the work day for golf can find time to practice indoors at the end of the day in their home.

Figure 3:
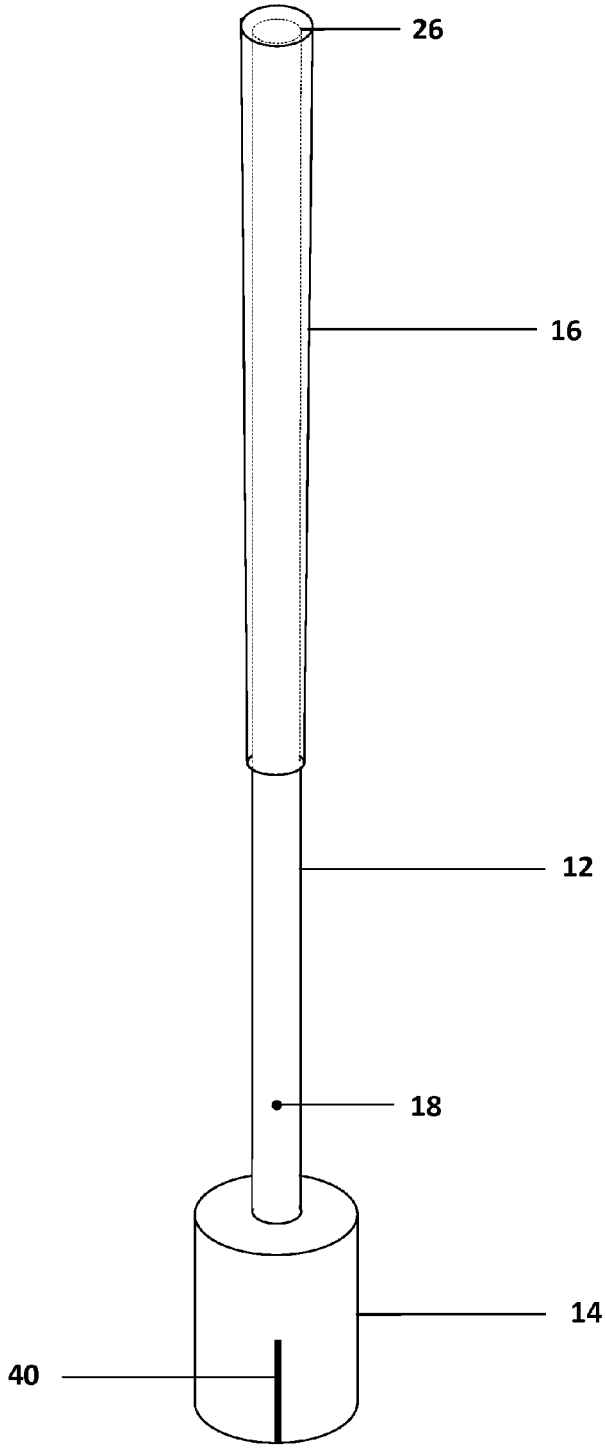
FIG. 3 is an isometric view of an alternative embodiment of the inventive practice implement with an indicium on the cylindrical weight.
Figure 4:
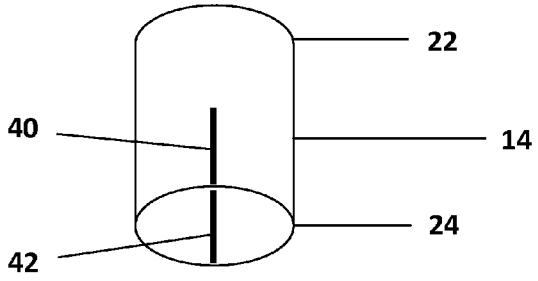
FIG. 4 is an isometric view of the cylindrical weight in the alternative embodiment including indicia on the side and distal end of the cylindrical weight.

As shown in FIGS. 3 and 4, the addition of an indicium 40 on the side of the cylinder 14 will allow the golfer to more easily see the position of the club head during his practice. The addition of an indicium 42 on the distal end of the cylinder will allow the golfer to see the club head position when practicing in front of a mirror. These indicia can either be cut into the cylinder as a groove or painted or printed on the cylinder or adhered to the cylinder.

Figure 5:
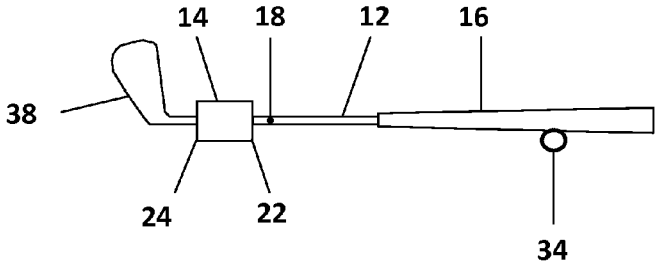
FIG. 5 is an elevation view of an alternative embodiment of the practice implement with a conventional golf club head added below the cylindrical weight.

An alternative embodiment shown in FIG. 5 includes the addition of a simulated conventional golf club head 38 below the cylindrical weight 14. The addition of the significant weight of the simulated golf club head 38 will require that the weight of the cylindrical weight 14 be reduced correspondingly to maintain the desired moment around the four inch swinging weight fulcrum point 34 and the desired location of the center of gravity as discussed above. The simulated golf club head 38 in this alternative embodiment functions in the same manner as the indicia shown in FIGS. 3 and 4.

Figure 8:
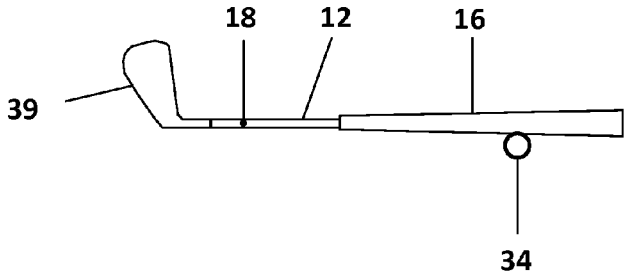
FIG. 8 is an elevation view of an alternative embodiment of the inventive practice implement with a simulated golf club head attached to the shaft.

An alternative embodiment shown in FIG. 8 includes a heavy simulated golf club head 39 attached to the shaft 12. The heavy simulated golf club head is significantly heavier than a standard golf club head in order to create in the practice implement a moment of between 9,500 and 11,000 inch grams resulting from the total mass of the practice implement at its center of gravity 18 acting around the four inch swing weighting fulcrum point 34 as shown in FIG. 8. This 9,500 to 11,000 inch gram moment is substantially similar to the corresponding moment of a conventional golf club as discussed above.

From the description above, a number of advantages of some embodiments of my practice implement become evident:

(a) The current invention reproduces the feel of full sized conventional golf is a very short practice implement which can be used indoors in very small spaces;

(b) The current invention is neutrally weighted with respect to both the feel of the total weighting and the eccentricity of the total weighting in relation to the shaft of the implement. The current invention will not induce in the hands of a golfer using the implement an exaggerated release or excessive momentum due to overweighting for muscle building or training.

(c) The current invention can be used all year long indoors by golfers in northern climates with limited access to outdoor golf facilities for many months of each year. The current invention can be used indoors in the kinds of very small spaces that are found in most single family homes, apartment or offices. This will allow skilled golfers to maintain their golf swings and golf fitness through the winter.

(d) The current invention can be stored standing vertically on its flat distal end. This very compact storage posture will allow it to be stored on any flat surface like a floor, a is table, a desk or a window sill.

Accordingly, it can be seen that the various embodiments of the indoor golf swing practice implement allow a golfer to practice indoors in very small spaces with a device that feels like a conventional golf club. The above embodiments are provided as exemplary of the invention and alternative configurations are contemplated and will become clear. For example, the cylindrical end weight could have other shapes, such as a chamfered edge, or an eased or rounded edge. Thus the scope of the embodiments should be determined by the appended claims rather than by the examples given.

The invention claimed is:

1. An indoor golf swing practice implement comprising:

an elongated shaft with a proximal end and distal end;

a weight secured to the distal end;

a total length in the range of sixteen and twenty inches;

a grip attached to and surrounding the proximal end of the shaft; and having a moment in the range of 9,500 to 11,000 inch grams about a fulcrum point four inches from the proximal end of the implement; and having a center of gravity located a distance from the distal end and toward the proximal end equal 20 to 25 percent the length of the implement.

2. An indoor golf swing practice implement, according to claim 1, and wherein the total length is eighteen inches.

3. An indoor golf swing practice implement, according to claim 1, and wherein the shaft has a diameter of ⅝ inches.

4. An indoor golf swing practice implement, according to claim 1, and wherein the shaft comprises aluminum or steel tube.

5. An indoor golf swing practice implement, according to claim 1, and wherein:

the weight has cylindrical shape and has a mass of in the range of 500 to 1000 grams.

6. An indoor golf swing practice implement, according to claim 1, and wherein:

the weight is shaped to simulate a golf head and has a mass in the range of 500 to 1000 grams.

7. An indoor golf swing practice implement, according to claim 1, and wherein;

the end weight has an indicium configured to indicate the alignment of a golf club head; each said indicium being either a notch or groove cut into cylindrical end weight, or a painted or printed and adhered mark.

8. A practice implement according to claim 1 wherein;

a simulated golf club head is attached to the distal end of the weight.

* * * * *